United States Patent [19]

Waters

[11] 4,184,862

[45] Jan. 22, 1980

[54] HEAT EXCHANGER GAS SEPARATOR

[75] Inventor: E. Dale Waters, Richland, Wash.

[73] Assignee: McDonnell Douglas Corporation, Long Beach, Calif.

[21] Appl. No.: 884,916

[22] Filed: Mar. 9, 1978

Related U.S. Application Data

[62] Division of Ser. No. 728,303, Sep. 30, 1976, Pat. No. 4,098,326.

[51] Int. Cl.[2] ..... F28F 9/00

[52] U.S. Cl. ..... 165/76; 165/162; 248/68 R

[58] Field of Search ..... 165/172, 159, 162, 76; 248/68 R, 68 C; 138/112

[56] References Cited

U.S. PATENT DOCUMENTS 2,534,690 12/1950 Young, Jr. et al. ..... 248/68 R 3,437,297 4/1969 Jirka et al. ..... 248/68 CB

FOREIGN PATENT DOCUMENTS 2001630 1/1971 Fed. Rep. of Germany ..... 248/68 CB

*Primary Examiner*—Albert W. Davis, Jr.
*Attorney, Agent, or Firm*—Henry M. Bissell

[57] ABSTRACT

A gas conveying duct-type heat exchanger is shown and described having two gases passing therethrough, preferably in counterflow relationship. An easily assembled, sectioned gas separator is provided to divide the duct into separate gas conduits. The separator sections are designed to fit with each other and to support heat pipes extending between adjacent conduits for transferring heat from one conduit to the next. The structure is adapted for ready on-site assembly and modification, thus providing facility in relating the constructed device to the heat load in a given installation and permitting shipment of a unit in disassembled condition.

11 Claims, 8 Drawing Figures

HEAT EXCHANGER GAS SEPARATOR

CROSS REFERENCE TO RELATED APPLICATION

This application is a division of co-pending application Ser. No. 728,303 filed Sept. 30, 1976, for HEAT EXCHANGER GAS SEPARATOR, now U.S. Pat. No. 4,098,326.

BACKGROUND OF THE INVENTION

1. Field of the Invention

This invention relates to gas flow heat exchangers and more particularly, to such devices utilizing heat pipes for facilitating heat exchange between separate gas passages.

2. Description of the Prior Art

In the past, it has been known to use air-to-gas heat exchangers wherein gas is conveyed adjacent air in opposite directions to transfer heat from the gas to the air. The air is heated for use at various locations, and the gas is cooled for environmentally safe exhaust into the atmosphere. A major problem with air-to-gas heat exchangers in the past has been air leakage into the gas passages. Such leakage not only reduces the effective thermal efficiency, but also may require the installation of larger fans or blowers and with attendant additional electrical energy required to drive such gas or air moving devices. Regenerative type heat exchangers further suffer from the disadvantage that alternate heating and cooling of the thermal storage and movement structure causes scaling, cracking and accelerated corrosion and erosion of the assembly. Heat pipe type heat exchangers overcome most of these problems, but usually require a complex assembly technique and a rigid installation which frequently is costly and difficult to fabricate.

So-called "heat pipes" are effective heat transfer elements by virtue of their containment of volatile liquid which cycles between liquid and vapor phases and circulates between hot and cold regions, transferring the heat of vaporization from the warmer to the cooler region. It is desired to provide a heat pipe type heat exchanger which uses heat pipes of a design easily mass produced. Moreover, it is desired to simultaneously obtain a heat pipe type heat exchanger which is easily assembled in the field at the point of use, but which can be quickly broken down for shipping and repair. However, a particular problem with such heat exchangers in the past has been the development of satisfactory arrangements for sealing the separators between the gas and the air passages in order to prevent leaking and reduce thermal and energy losses.

SUMMARY OF THE INVENTION

In brief, particular arrangements in accordance with the invention comprise a duct having separate interior conduits for hot gases and cooling air. A separator between the interior conduits is made up of a series of elongated spacer beams extending between opposite sides of the duct and supported on side rails. Adjacent elongated beams are placed side-by-side along the length of the duct in which the interior is to be divided into respective conduits. The beams have a series of indentations with the indentations from adjacent beams in alignment with each other. Each beam is placed overlapping an adjacent beam, and pluralities of heat pipes are held within the overlapping indentations. The heat pipes are arranged generally perpendicular to the separator assembly comprising the elongated beams side-by-side. The heat pipes may be anchored at the bottom by an assembly of anchor plates, and may be affixed to the ceiling of the duct by T-slot channels also arranged side-by-side throughout the duct. The elongated beams rest on side rails positioned on opposite sides within the duct according to the division therein desired for the interior conduits. In the preferred embodiment, U-channels are formed within the elongated beams to provide structural strength along the longitudinal dimension.

In an alternative embodiment, elongated beams are formed without structurally stiffening U-channels. Alternative methods of supporting the longitudinal dimension of the elongated beams are described, including I-beams placed underneath the elongated beams. With such structural support, the spacer assembly is capable of supporting substantial loads, if desired.

In other alternative embodiments, leakage of gases from one conduit to the adjacent conduit on the other side of the spacer assembly is limited by sealing strips, annular sealing rings around heat pipes and specially constructed grommet halves which are joined when adjacent beams are positioned overlapping each other. Alternatively, the indentations may be constructed having generally parallel sides or having sides which extend toward each other as they extend from their corresponding elongated beam edge for greater ease and tolerance in assembling the spacer assembly. Annular fins are preferably located along the length of the heat pipes in both adjacent conduits for the purpose of transferring heat between the conduits and the heat pipes.

The indentations of adjacent beams are aligned so that when adjacent beams overlap, indentations will overlap. Indentations on one edge of a beam may be staggered or aligned midway between longitudinal distances of indentations on the opposite edge of the same beam. Alternatively, the indentations of one edge of the beam may be directly aligned with the indentations of the opposite edge of the same beam. Each alternative arrangement provides corresponding alternative patterns for the positioning of the heat pipes throughtout the conduits.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENT

Figure 1:
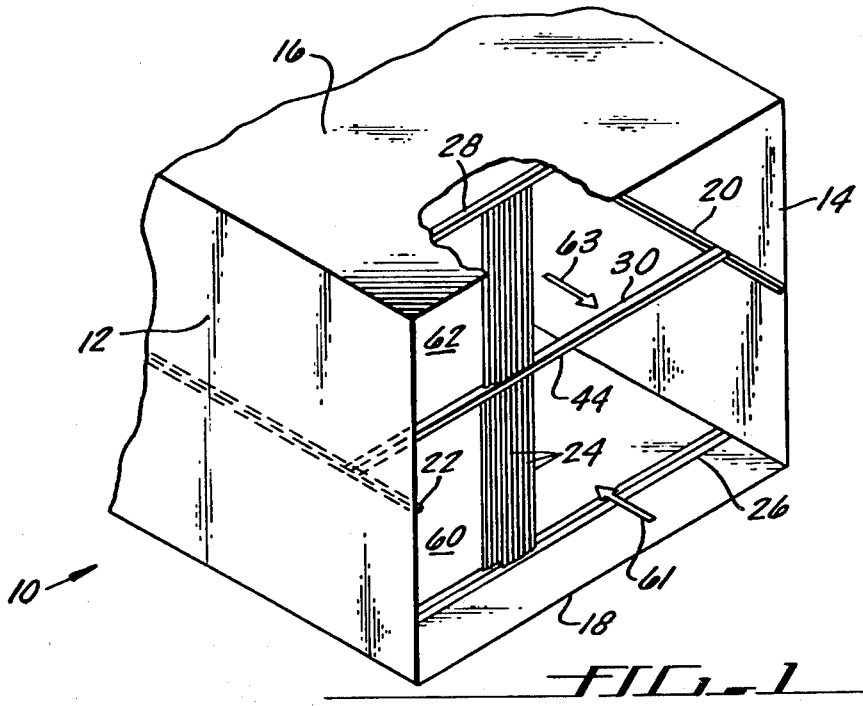
FIG. 1 is a perspective view, partially broken away of one particular embodiment of the invention.
Figure 2:
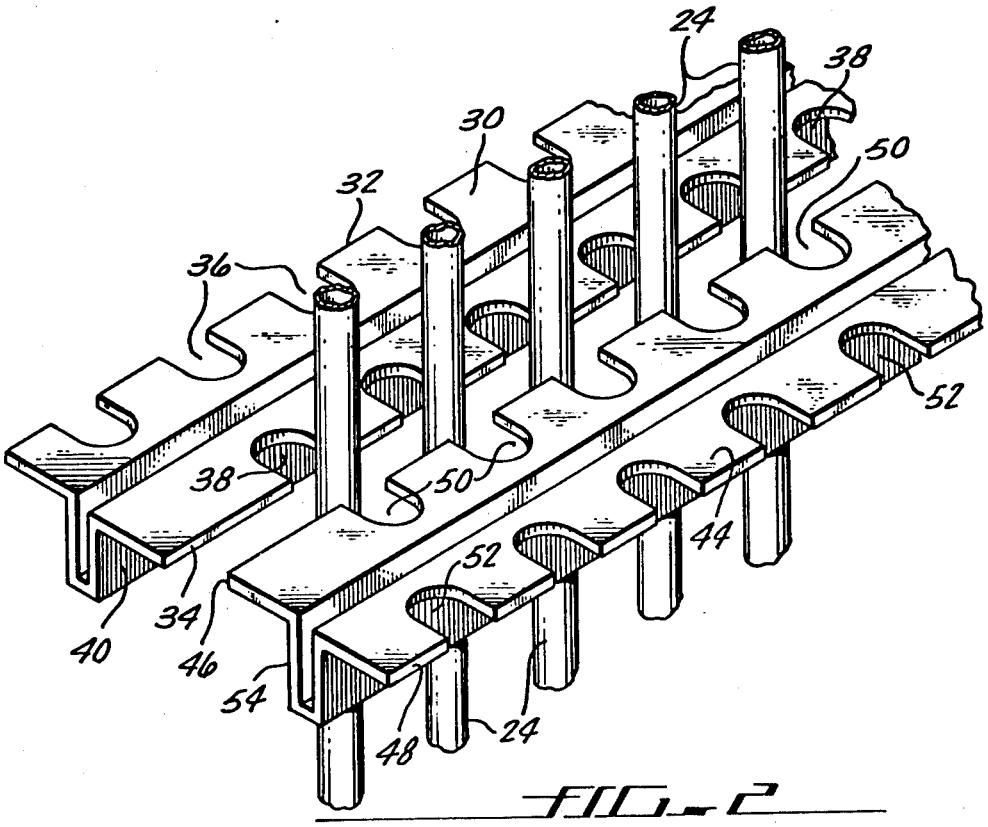
FIG. 2 is an exploded view of a portion of the embodiment of FIG. 1 showing the elongated beams and heat pipes in relative position preparatory to assembly.
Figure 3:
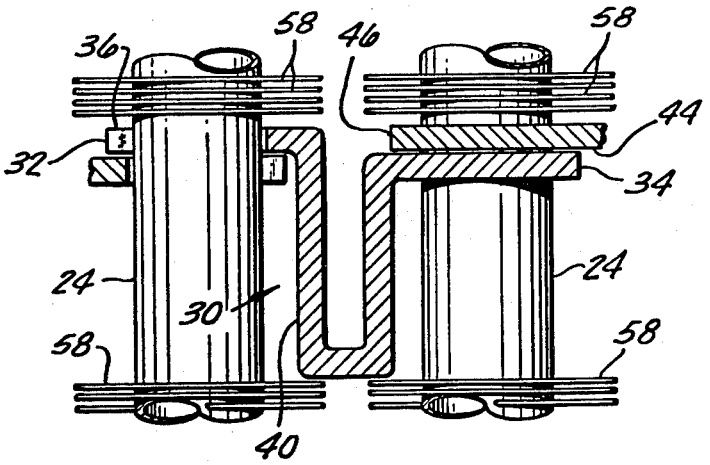
FIG. 3 is an elevational view in section showing the separator sections and the heat pipes as assembled.
Figure 7:
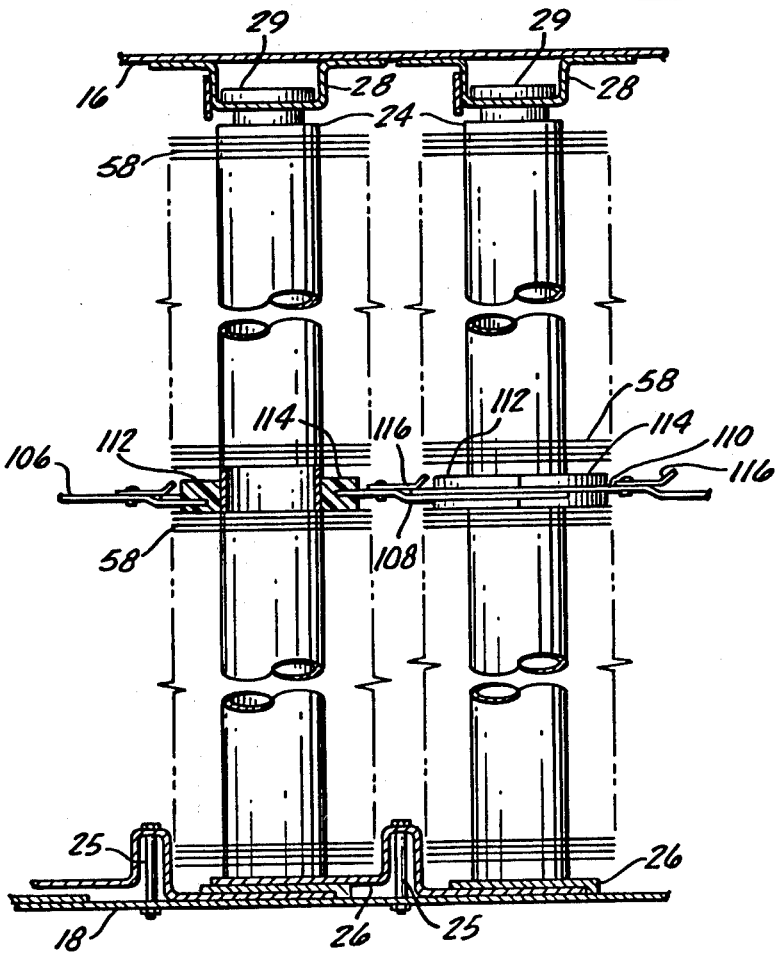
FIG. 7 is still another alternative embodiment of the invention in cross-section, elevational view.

Referring now to FIGS. 1, 2 and 3, an air and gas duct 10 is seen having sidewalls 12 and 14, a top 16 and a bottom 18. Side rails 20, 22 are positioned along corresponding sides 14, 12 approximately midway of the vertical dimension. The side rails 20, 22 extend substantially the entire length of the duct 10 which is desired to be separated into two interior conduits in which heat pipes 24 are situated. The heat pipes 24 extend from the bottom 18 to the top 16. Along the bottom, the heat pipes 24 are positioned in anchor plates 26 which extend along the bottom 18 from side 12 to side 14 and are tried to the bottom 18 by suitable fastenings such as the bolts 25 (FIG. 7). The heat pipes 24 are secured to the top 16 in T-slot channels 28 which extend along the ceiling from side 12 to side 14. The upper end of each heat pipe 24 is shaped with an outwardly extending shoulder 29 (FIG. 7) to engage the T-slot channels 28 for support therein. Each T-slot channel 28 and anchor plate 26 comprises essentially an elongated channel or plate which is adapted to be positioned adjacent similar channels 28 or plates 26 for that length in the duct 10 in which the heat pipes 24 are situated.

Resting on the side rails 20, 22 is a series of elongate beams 30, 44, each beam extending from one rail 22 to the rail 20 on the opposite side. As seen best in FIG. 2 of the drawings, the elongate beam 30 has a first edge 32 and a second edge 34 extending along opposite longitudinal sides of the beam 30. Extending inwardly from the first edge 32 are generally U-shaped indentations 36 having substantially parallel sides extending from the edge 32. Extending inwardly from the second edge 34 are generally U-shaped indentations 38 similarly having generally parallel sides extending from the second edge 34.

The beam 44, separated from beam 30 in this view, similarly has a first longitudinal edge 46 and a second longitudinal edge 48. Extending inwardly from the first edge 46 and having generally parallel opposite sides are indentations 50. Extending inwardly from the opposite second edge 48 and also having generally parallel sides are generally U-shaped indentations 52. The indentations 50 on beam 44 are aligned so that when beam 44 is placed between the side rails 20, 22 the indentations 50 are positioned to coincide or overlap the indentations 38 on the next adjacent beam 30 when it likewise is placed upon the side rails 20, 22. The indentations 52 are positioned along the beam 44 spaced midway along the longitudinal distance between the indentations 50 on the opposite edge 46. Similarly, the indentations 36 are aligned midway along the longitudinal distance between indentations 38 on the opposite edge of beam 30.

In assembling the structure of the invention, when the beam 30 is placed on the side rails 20, 22, it is positioned toward the beginning of the duct 10. Heat pipes 24 are then aligned with indentations 38, having their bottom ends positioned in anchor plates 26, and their top ends positioned in T-slot channels 28. The next adjacent beam 44 is then placed on side rails 20, 22. The indentations 50 coincide with the indentations 38. As the beam 44 is slid over beam 30, each heat pipe 24 is positioned within an aperture formed by opposing indentations 38 and 50. Edge 46 of beam 44 is made at a higher vertical elevation than second edge 34 of beam 30. Thus, the edge 46 will slide over the edge 34, allowing the indentations 50 to securely hold the heat pipes 24 in perpendicular relation to the beams 30, 44.

As might be appreciated from the view of FIG. 1, the lateral distance between the side rails 20 and 22 may be considerable. It is helpful, therefore, to have some structural support for elongated beams 30, 44. As shown in FIGS. 2 and 3 of the drawings, a generally U-shaped channel 40 is formed on beam 30. A similar U-shaped channel 54 is formed on beam 44. The U-shaped channels, in addition to providing structural support for the entire longitudinal dimension of the beams 30, 44, also provide a suitable means of having one longitudinal edge 32, 46, raised relative to its opposite longitudinal edge 34, 48. As seen in FIG. 3, the heat pipes 24 have positioned thereabout annular fins 58. The fins serve to collect and dissipate heat from the heat pipes 24 from and into the atmosphere surrounding the heat pipes in the duct 10.

In operation, a large number of beams 30, 44 are positioned resting on side rails 20, 22 along the longitudinal length of the duct 10, the interior of which is to be divided into two conduits. Heat pipes 24 are positioned perpendicularly to the beams 30, 44 within the various indentations such as indentations 38, 50. The heat pipes 24 are secured at their bottom ends in anchor plates 26, if desired. Exhaust gases can then be exhausted through, for example, the lower conduit 60 of the duct 10 in the direction as indicated by the arrow 61. Fresh or cool air can then be inserted into the working area through the conduit 62 as indicated by the arrow 63. As may be appreciated by the view of FIG. 1, the cold air then is maintained separated from the hot exhaust gases. The heat pipes 24 extend through the separating spacer assembly formed by the elongate beams 30, 44 thus conveying heat from the exhaust conduit 60 to the cooling air intake conduit 62. The fins 58 greatly assist in collecting heat to the heat pipes 24 in the exhaust conduit 60, and greatly assist in distributing the heat in the cool-air conduit 62. As assembled in this embodiment, the heat pipes have a staggered or triangular pattern since the beams which act as spacers have alternating indentation designs on opposite edges.

The generally U-shaped channels 40 and 54 may extend downwardly into the exhaust gas conduit 60, and perpendicular to the exhaust gas flow 61, or upwardly into the cooling air conduit 62 and perpendicular to the cooling air flow 63. The surfaces of the U-shaped channels 40, 54, therefore, can provide additional heat collecting surfaces for dissipating the heat into the cool air intake conduit 62.

Figure 4:
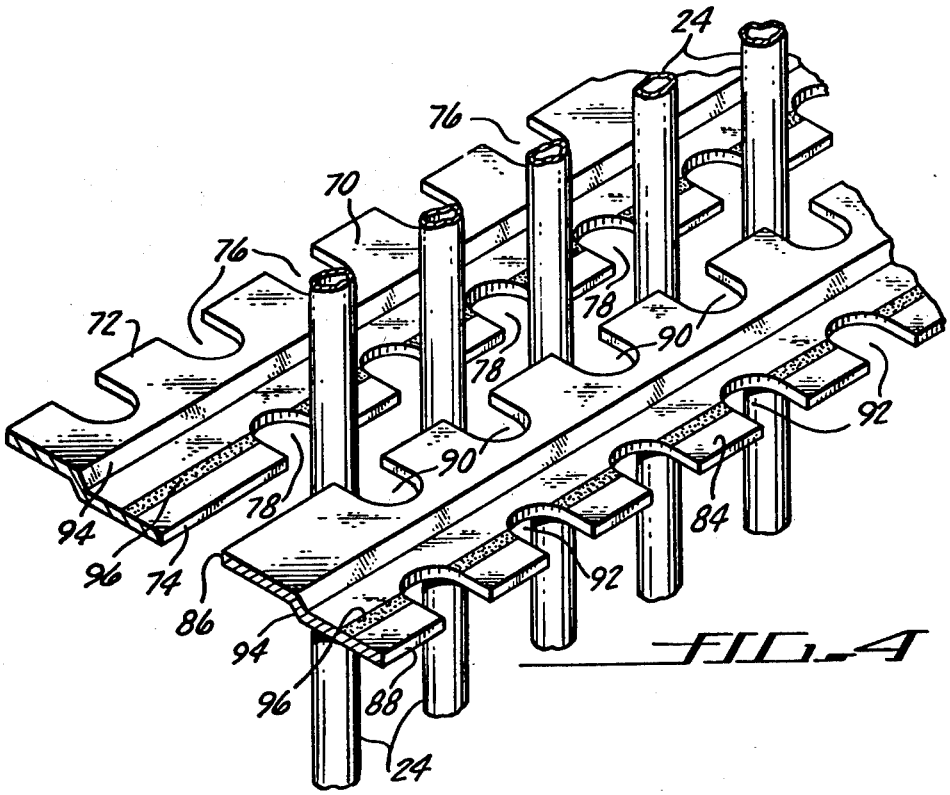
FIG. 4 is an exploded view of an alternative arrangement to the separator sections of FIG. 2.
Figure 5:
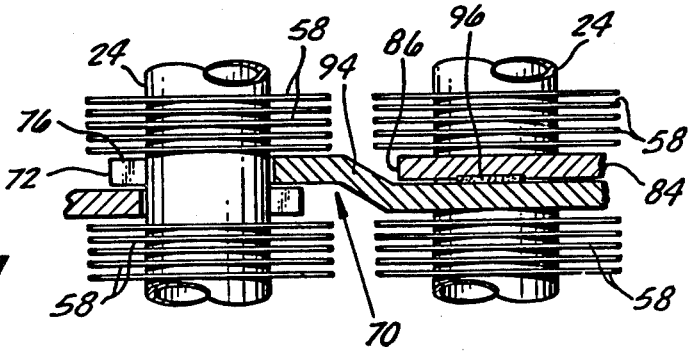
FIG. 5 is an elevational view in section showing the assembly of the alternative embodiment of FIG. 4.

Referring now to FIGS. 4 and 5 of the accompanying drawings, an alternative embodiment of the invention can be seen. Elongate beams 70 and 84 are shown in partially exploded preassembled position. Beam 70 has a first longitudinal edge 72 and a second longitudinal edge 74. Beam 84 has a first longitudinal edge 86 and a second longitudinal edge 88. Extending inwardly from the first longitudinal edge 72 are generally U-shaped indentations 76 having generally parallel sides. Extending inwardly from second edge 74 are generally U-shaped indentations 78 again having generally parallel sides. Extending inwardly from first edge 86 of beam 84 are similarly shaped indentations 90. Also, similarly shaped indentations 92 extend inwardly from second edge 88.

Indentations 78, 92 extending inwardly from corresponding second edges 74, 88 are positioned longitudinally midway between the indentations 76, 90 extending from their corresponding edges 72, 86. The indentations 90 of every other or second beams 84 are longitudinally positioned to match the indentation 78 extending from the second edge of the first beam 70. When the second or every other beam 84 is positioned so that its first edge 86 overlaps the second edge 74 of the first beam 70, the indentations 90 will exactly overlap the indentations 78 to secure therewithin heat pipes 24.

The embodiment of FIGS. 4 and 5 differs from the preferred embodiment in that there is no generally U-shaped channel extending along the longitudinal dimension of the beams 70, 84. Instead, the first and second edges of each beam are connected merely by an inclined ramp 94, as indicated.

It may also be desired to improve the ability of the overlapping beams 70, 84 to prevent the hot exhaust gases in conduit 60 from escaping into the cool air conduit 62. If it is believed that the leakage of the gases through the overlapping beams 70, 84 will be excessive, a sealing material such as sealing strips 96 may be placed on either the top side or the bottom side of the elongated beams 70, 84. If the strips 96 are placed on the top side, they should be positioned on the lower edge 74, 88. The strips could also be placed on the bottom side of the higher edges 72, 86. In such a manner, the gases are blocked from escaping through the longitudinal seams formed by the overlapping of the elongate beams 70, 84.

Figure 6:
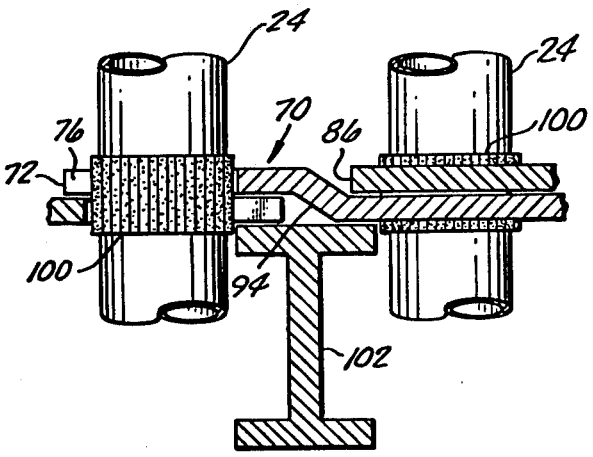
FIG. 6 is an elevational view in section of another alternative embodiment of the invention to those shown in FIGS. 2 and 4.

FIG. 6 of the drawings shows yet another alternative embodiment of the invention, providing even more effective sealing between the hot exhaust conduit 60 and the cool air intake 62. An elongate beam 70 is seen in cross-section, elevation view having a first edge 72 and a second, vertically lower edge 74. The two edges are connected by a ramp shaped portion 94. Indentations such as indentation 76 are provided extending inwardly from the respective edges. Heat pipes 24 are secured perpendicularly to the elongate beams by the coinciding, overlapping indentation.

An annular sealing ring 100 is provided surrounding each heat pipe 24. The rings 100 are vertically aligned along the heat pipe 24 so as to coincide with the vertical height of the elongate beams 70. Thus, when the heat pipes 24 are perpendicularly secured within the overlapping, coincidental indentations, the annular sealing ring 100 provides an airtight seal through its contact with the interior sides of the indentations.

If it is necessary or desired that the spaced elongate beams should support weight or a load, it is possible to reinforce the beams as with an I-beam 102 as seen in cross-section elevational view in FIG. 6. Such additional structural support for the elongate beams along the longitudinal dimension of the beams should not be necessary where U-shaped channels are provided within the beam itself. On the relatively flat beams 70, 84, however, such additional structural support may be found desirable.

In FIG. 7, an additional alternative concept providing pneumatically sealed connections between the heat pipes 24 and the perpendicularly positioned elongate beams is shown. In FIG. 7, the heat pipes are seen in a partial cross-sectional elevation view positioned between anchor plates 26 and T-slot channels 28. Elongate beams 106, 108 and 110 are seen in cross-section view. The beams 106, 108, 110 are designed having substantially narrower height dimensions.

Grommet halves 112, 114 having small inlet channels formed therein are slipped over the indentations of the elongate beams 106, 108 and 110. Thus, when the overlapping indentations of adjacent beams are positioned to hold the heat pipes securely in perpendicular relation thereto, the two grommet halves 112, 114 are joined to form a complete grommet. Such a complete grommet may be used as a substitute for the annular ring 100 seen in FIG. 6 of the drawings.

A small securing plate 116 may be positioned on the elongate beams at a point where the elongate beam inclines from one vertical level to another. In such a manner, the overlapping edge of the adjacent beam can be slipped between the plate 116 and the elongate beam for a tighter, more airtight seal between the beams.

Figure 8:
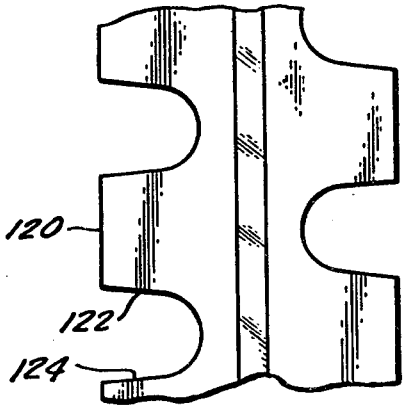
FIG. 8 is a partial top view of a portion of a separator beam showing yet another alternative embodiment.

FIG. 8 shows an alternative shape to the generally U-shaped indentations found in all of the elongate beams. Instead of having generally parallel sides extending from the edge 120, the sides of the indentation may be made to converge as the indentation extends from the edge 120. Thus, sides 122, 124 converge toward the semi-circular indentation end. This alternative shape for the indentation greatly expands the tolerance for minor deviations in the beams, and generally facilitates the assembly of the beams into a unified spacer assembly dividing the interior of the duct 10 into conduits 60, 62.

It can be appreciated that when a series of such elongate beams as described above are placed along the side rails 20, 22 in overlapping, airtight assembly, a spaced heat pipe air-to-gas separator is provided which can be easily assembled in the field, thus saving shipping costs for large complex structures. Moreover, heat pipes of a unitary design which are easily mass produced can be used. The assembly structure, moreover, can be changed and modified in the field to accommodate different duty requirements. The gas-to-air seal is low in cost and greatly reduces thermal and electrical power losses and excesses. The vertical distance of the side rails 20, 22 can be modified to accommodate the desired cross-sectional areas of the exhaust conduit 60 relative to the cool air intake 62.

Although there have been described above several specific arrangements of an air-to-gas spacing and sealing assembly in accordance with the invention for the purpose of illustrating the manner in which the invention may be used to advantage, it is to be appreciated that the invention is not limited thereto. It may be desired, for example, to provide a uniform incline from the elongate beam first edge to its second edge, having adjacent beams overlapping each other along the inclined surface. Additionally, it may be desired to have the generally U-shaped indentations extending from the second edge of each beam aligned directly with the generally U-shaped indentations extending from the first edge of the same beam. In such a manner, instead of a triangular or staggered pattern of heat pipes, a generally linear pattern of heat pipes will be provided. Accordingly, any and all modifications, variations or equivalent arrangements which may occur to those skilled in the art should be considered within the scope of the invention as defined in the appended claims.

What is claimed is:

1. A heat exchanger separator structure comprising: means for receiving a plurality of generally parallel, heat exchanging elements extending between first and second fluid passages and for providing a substantially gas-tight separator for fluids in the first and second passages, respectively, said means including a plurality of respective overlapping sections, each section being in the shape of an elongate beam having a top side, a bottom side, a first edge and a second edge, wherein along the first edge and along the second edge are spaced generally U-shaped indentations adapted to receive heat exchanging elements in perpendicular relation thereto, and wherein the first edge is vertically lower than the second edge in order that when two such elongate beams are positioned together, the first edge of one overlaps the second edge of the other in horizontal relationship to each other; and means for supporting the elongate beam sections in an integral extended structure.

2. The device of claim 1 wherein the top side includes sealing means for sealing the contact between adjacent overlapping elongate beams.

3. The device of claim 2 wherein the sealing means comprises at least one resilient sealant strip extending along the space between overlapping first and second edges.

4. The device of claim 1 wherein each U-shaped indentation includes a grommet half for sealing the contact between an associated heat exchanging element and the elongate beam.

5. The device of claim 1 further comprising an annular seal within each opening defined by adjacent pairs of U-shaped indentations in first and second overlapping edges, the seals being positioned to seal and to comprise the contact between the heat exchanging elements and the elongate beams.

6. The device of claim 1 wherein each generally U-shaped indentation has parallel sides extending from its corresponding edge.

7. The device of claim 1 wherein each generally U-shaped indentation has sides extending toward each other from its corresponding edge.

8. The device of claim 1 wherein the supporting means comprises a U-shaped channel extending from the elongate beam between the indentations extending from the first edge and the indentations extending from the second edge.

9. The device of claim 1 wherein the supporting means comprises an I-beam positioned in alignment along the elongate beam and adapted to support the load thereof.

10. The device of claim 1 further comprising means for sealing gaps between overlapping sections and between the sections and the heat exchanging elements.

11. The device of claim 10 wherein the sealing means comprises a securing plate attached to one elongate beam and defining therewith a space for receiving the overlapping edge of an adjacent beam in airtight sealing relationship between the overlapping edges.

* * * * *